US006331038B1

(12) United States Patent
Boleda et al.

(10) Patent No.: US 6,331,038 B1
(45) Date of Patent: Dec. 18, 2001

(54) TECHNIQUES FOR ROBUST DOT PLACEMENT ERROR MEASUREMENT AND CORRECTION

(75) Inventors: Miquel Boleda, Barcelona (ES); Jose J Doval, Escondido, CA (US); Albert Serra; Xavier Gros, both of Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/492,553

(22) Filed: Jan. 27, 2000

(51) Int. Cl.[7] ..... B41J 29/38; B41J 29/393
(52) U.S. Cl. ..... 347/9; 347/19
(58) Field of Search ..... 347/9, 14, 19, 347/41, 43

(56) References Cited

U.S. PATENT DOCUMENTS

| | | | |
|---|---|---|---|
| 4,187,511 | 2/1980 | Robinson | 347/7 |
| 4,943,813 | 7/1990 | Palmer et al. | 347/41 |
| 5,835,108 | 11/1998 | Beauchamp et al. | 347/19 |
| 5,914,731 | 6/1999 | Yano et al. | 347/9 |
| 6,007,181 | 12/1999 | Takahashi | 347/41 |
| 6,015,201 | 1/2000 | Asakura | 347/19 |

*Primary Examiner*—John Barlow
*Assistant Examiner*—A. Dudding

(57) ABSTRACT

Techniques to compensate for random and systematic errors when measuring dot placement errors. Error accumulation due to scan axis irregularities during printhead calibration is minimized by swapping alignment block positions on the print medium from swath to swath. Print media advances during the calibration are minimized by the use of a moving reference instead of a constant reference; adjacent groups of nozzles are used to calibrate the following group. Only a small media advance is needed to print alignment blocks using adjacent nozzle groups one beside the other to be calibrated. To prevent paper slip accumulative errors when using moving references, the order of the groups of nozzles is swapped from one paper advance to the other. This randomizes for small, unavoidable slips when advancing the paper and prevents error accumulation. No further paper advances are used at all for the rest of the dot placement calibration (odd to even columns in a print-head, pen to pen correction and bidirectional correction). When calibrating X-axis position for a group of nozzles, a group of nozzles located at the same Y-axis coordinate is used, so that no paper advances are needed to print them one beside the other.

22 Claims, 13 Drawing Sheets

TECHNIQUES FOR ROBUST DOT PLACEMENT ERROR MEASUREMENT AND CORRECTION

CROSS-REFERENCE TO RELATED APPLICATIONS

This application is related to co-pending application Ser. No. 09/199,882, entitled ALIGNMENT OF INK DOTS IN AN INKJET PRINTER, filed Nov. 24, 1998, the entire contents of which are incorporated herein by this reference.

TECHNICAL FIELD OF THE INVENTION

This invention relates to inkjet printers, and particularly to techniques for measuring and correcting for dot placement errors.

BACKGROUND OF THE INVENTION

Exemplary embodiments of this invention will be described with respect to large format printers, although the invention can also be practiced on other types of printers.

Large scale plotters typically support roll-form print media, i.e., a supply of paper or transparent film on a roll. The media is loaded into the printer, and is advanced along a media path to a print area. A swath-type printer includes a carriage mounted for scanning movement along a swath axis, transverse to the media path at the print area. Hereafter, the media path is known as the X-axis, and the scanning or swath axis is the Y-axis. For color printing, the carriage holds a plurality of ink-jet printheads, each for printing a different color ink, typically black, cyan, magenta and yellow. The printer will include a media drive mechanism for moving the media along the media path, and a carriage drive mechanism for scanning the carriage along the scan axis. The printer controller issues print control signals to cause the printheads to eject droplets of ink in a controlled manner to form a desired image or plot on the medium.

Ink-jet printing is based on accurate ballistic delivery of small ink droplets to exact locations onto the paper or other media. Typically the droplet placement occurs onto a grid of different resolutions, most common grids being 300×300 dpi or 600×600 dpi, although other solutions are continuously being considered. One key factor for sharp and high quality images stems from the accuracy of the droplet placement.

There are several contributors to droplet placement inaccuracies. Some of these arise from the printer and some other from the printhead. They can occur along the scan axis or the media path directions. Some inaccuracies are systematic, while some others follow random patterns. Some of these errors can also affect the correction algorithm itself.

Several factors contribute to error in paper movements. The media roll is typically mounted in the printer on an axis or spindle. The spindle is prevented from turning at idle by a friction brake. This creates "back-tension" which helps the media auto-alignment. The media auto-alignment process includes X-axis movements, i.e. movements along the media advance direction, and rotations of the paper to prevent skew and mispositioning of the paper on the print zone. These movements create some undesirable paper slip on the print zone that negatively affect dot placement. These errors affect both printing and also dot placement calibration.

Some other movements have been detected when advancing the paper with back-tension. These movements are due to irregularities on the pinch-wheels as well as different pressures between pinch-wheels and roller and media tensions along the X-axis.

These factors can create several problems. When calibrating Y-axis directionality, i.e. where Y is the carriage scan axis direction, the back-tension creates large media slips. These movements include advance errors, X-axis displacements and rotations about a vertical (Z) axis.

When calibrating scan-axis directionality for the reference printhead, some advances are needed to print and measure dot placement along the printhead length. Some paper slip during these measurements could affect the calibration, causing the dots printed before the paper advance to be in a different X axis coordinate after the paper advance, and therefore measured at an incorrect distance to the next printed dots.

SUMMARY OF THE INVENTION

A technique to compensate for random and systematic errors when measuring dot placement is described, and results in reduction or elimination of paper movements during the dot placement calibration as well as avoidance of error accumulation.

An aspect of the invention is a technique to compensate for random and systematic errors when measuring dot placement errors. One solution for error accumulation due to scan axis irregularities includes swapping alignment block positions on the print medium from swath to swath. The paper advances are minimized by the use of a moving reference instead of a constant reference, i.e. using adjacent groups of nozzles to calibrate the following group. In this technique only a small paper advance, e.g. in an exemplary embodiment, a 64 dot rows advance for a 32 dot primitive at 300 dpi, is needed to print adjacent nozzle groups one beside the other to be calibrated.

In accordance with a further aspect of the invention, to prevent paper slip accumulative errors when using moving references, the order of the groups of nozzles is swapped from one paper advance to the other. This randomizes for small, unavoidable slips when advancing the paper and prevents error accumulation.

In accordance with a further aspect of the invention, no more paper advances are used at all for the rest of the dot placement calibration (odd to even columns in a print-head, pen to pen correction and bi-directional correction). When calibrating X-axis position for a group of nozzles, a group of nozzles located at the same Y-axis coordinate is used. Therefore no paper advances are needed to print them one beside the other.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

This invention provides a method to measure and correct droplet placement errors, and provides robustness to some systematic and random errors when measuring dot placement error, particularly paper skew, paper slip, X axis advance errors (due to roller and/or gears), and paper growth due to ink.

A typical embodiment of the invention is exemplified in a large format color inkjet printer/plotter. Commonly assigned U.S. Pat. No. 5,835,108, entitled CALIBRATION TECHNIQUE FOR MISDIRECTED INKJET PRINTHEAD NOZZLES, describes an exemplary device which can employ the recent invention. FIGS. 1–8 and the following description of these figures are generally taken from this patent, the entire contents of which are incorporated herein by this reference.

Figure 1:
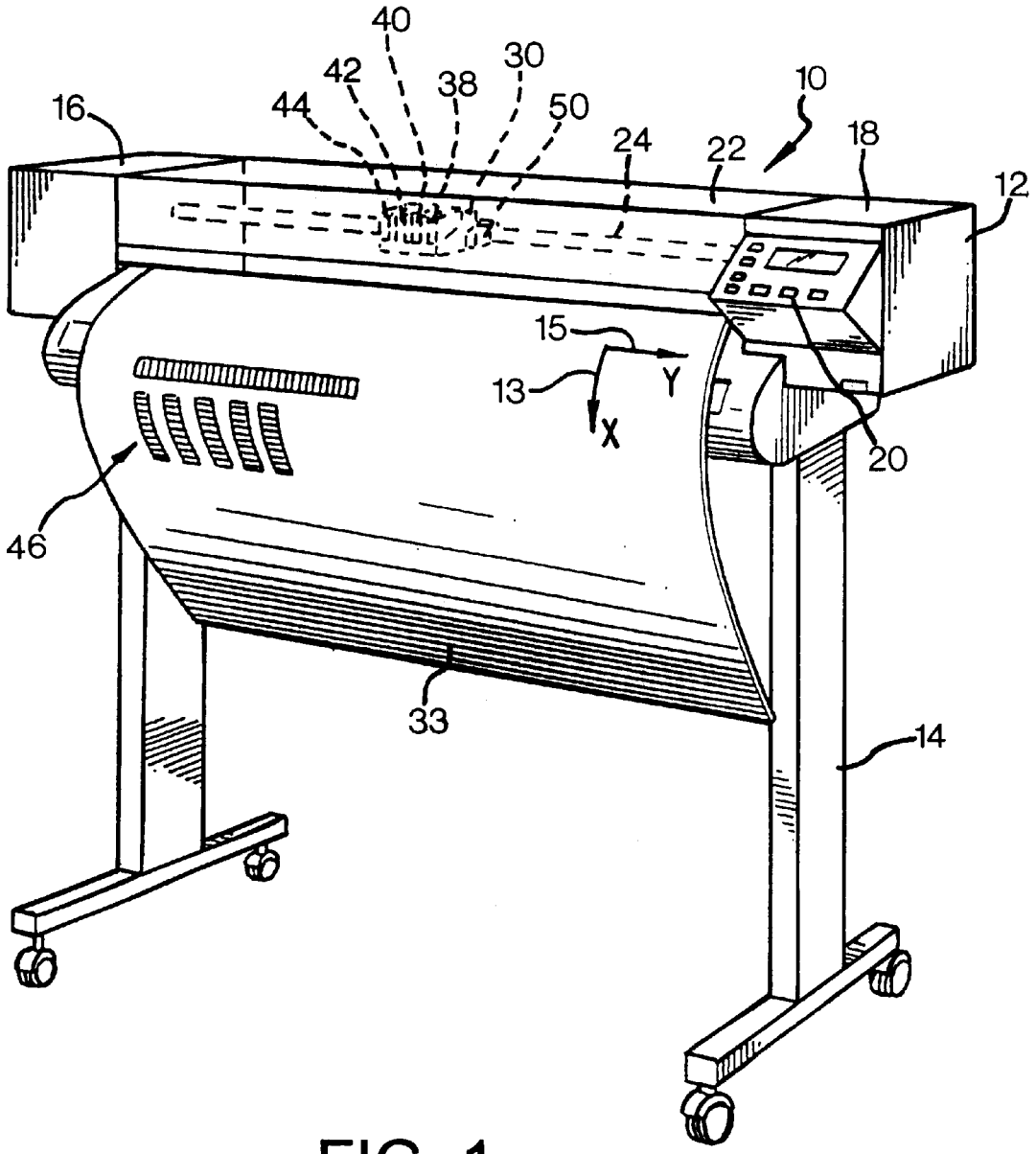
FIG. 1 is a perspective view of a large format inkjet printer/plotter incorporating the features of the present invention.

FIG. 1 is a perspective view of an inkjet printer/plotter 10 having a housing 12 mounted on a stand 14. The housing has left and right drive mechanism enclosures 16 and 18. A control panel 20 is mounted on the right enclosure 18. A carriage assembly 30, illustrated in phantom under a cover 22, is adapted for reciprocal motion along a carriage bar 24, also shown in phantom. The position of the carriage assembly 30 in a horizontal or carriage scan axis is determined by a carriage positioning mechanism 31 with respect to an encoder strip 32 (see FIG. 2). A print medium 33 such as paper is positioned along a vertical or media axis by a media axis drive mechanism (not shown). As used herein, the media axis is called the X axis denoted as 13, and the scan axis is called the Y axis denoted as 15.

Figure 2:
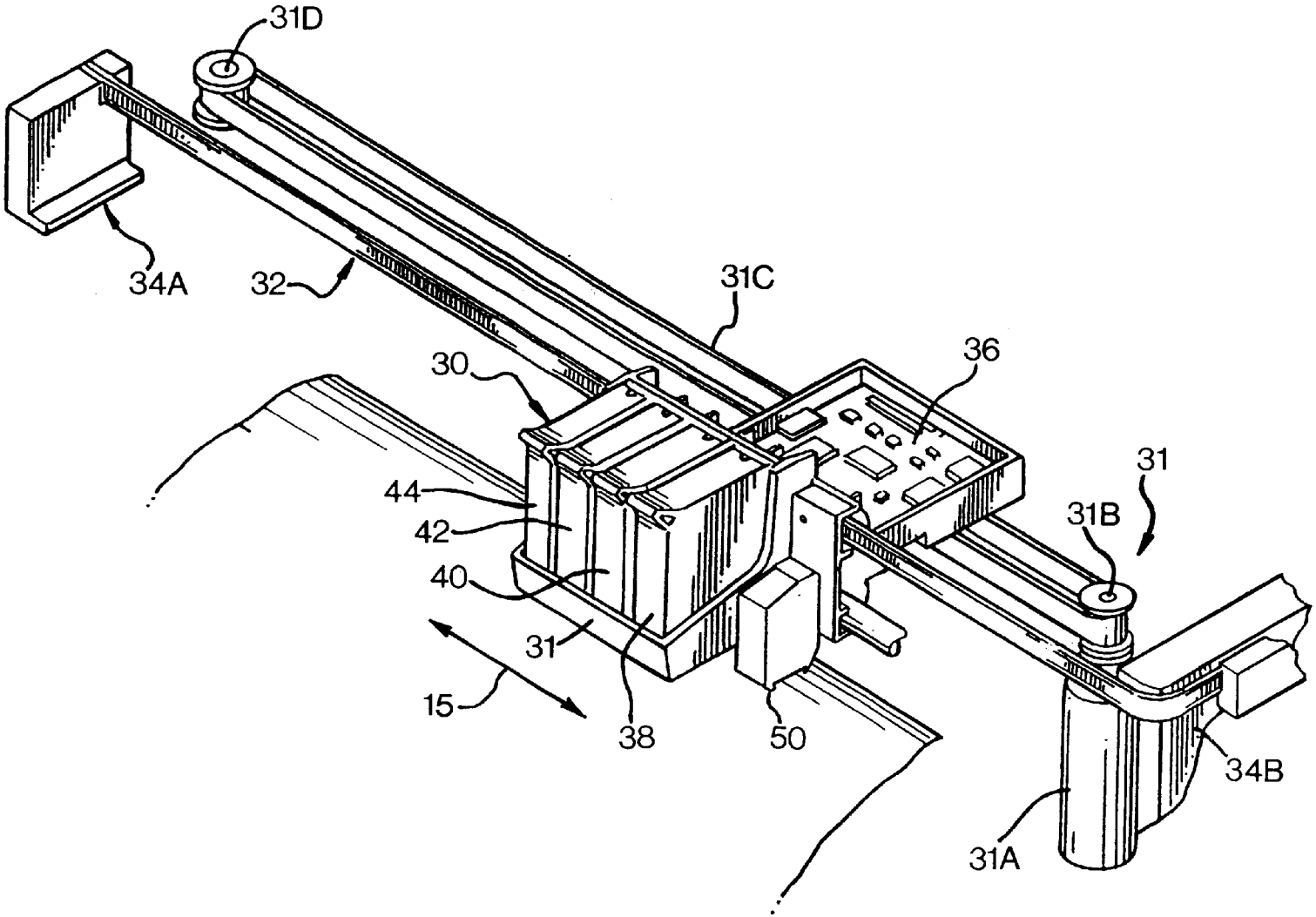
FIG. 2 is a close-up view of the carriage portion of the printer/plotter of FIG. 1 showing a carriage-mounted optical sensor.

FIG. 2 is a perspective view of the carriage assembly 30, the carriage positioning mechanism 31 and the encoder strip 32. The carriage positioning mechanism 31 includes a carriage position motor 31A which has a shaft 31B which drives a belt 31C which is secured by idler 31D and which is attached to the carriage 30.

The position of the carriage assembly in the scan axis is determined precisely by the encoder strip 32. The encoder strip 32 is secured by a first stanchion 34A on one end and a second stanchion 34B on the other end. An optical reader (not shown) is disposed on the carriage assembly and provides carriage position signals which are utilized by the invention to achieve image registration in the manner described below.

Figure 3:
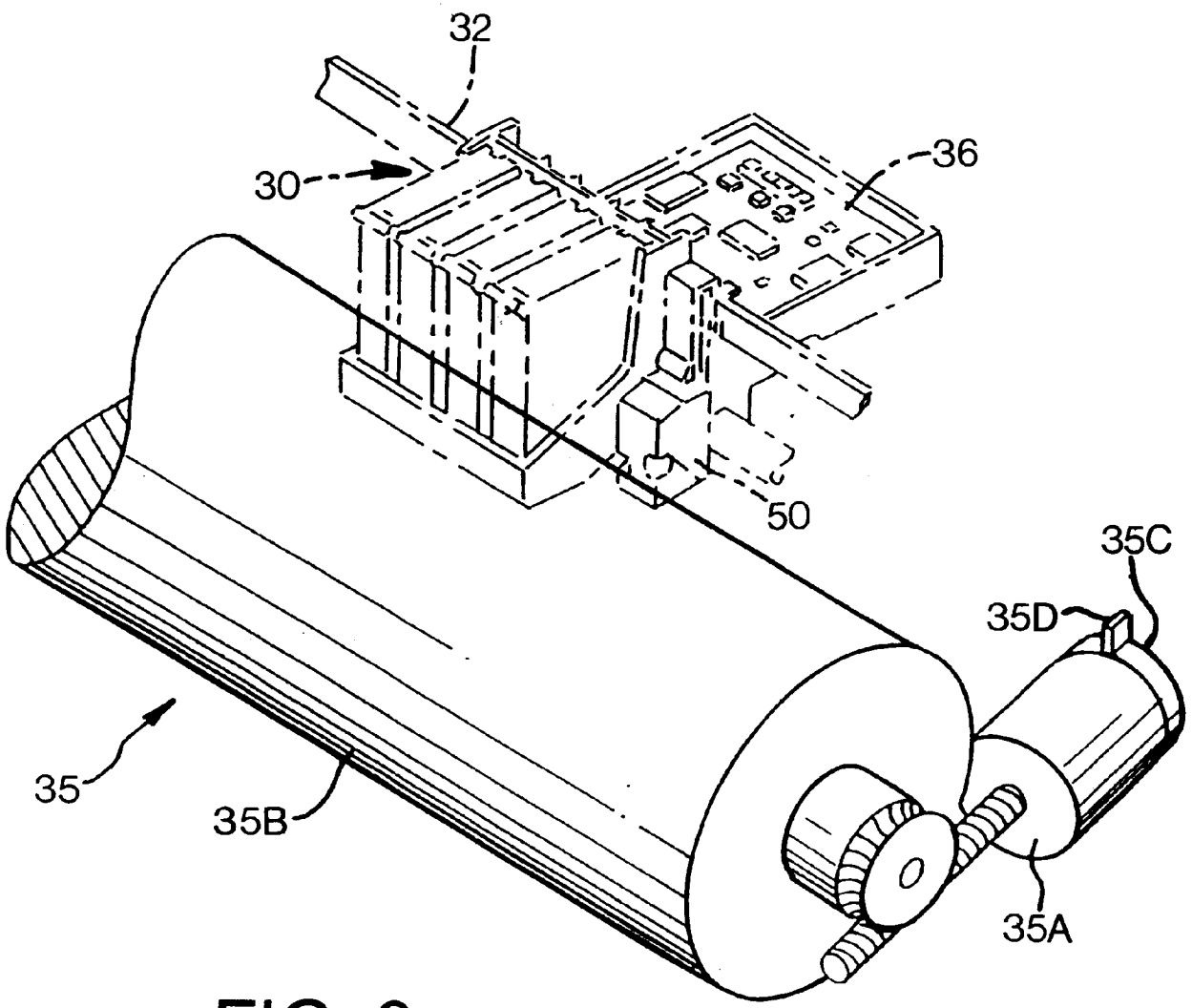
FIG. 3 is a close-up view of the platen portion of the printer/plotter of FIG. 1 showing the carriage portion in phantom lines.

FIG. 3 is a perspective view of a simplified representation of a media positioning system 35 which can be utilized in the inventive printer. The media positioning system 35 includes a motor 35A which is normal to and drives a media roller 35B. The position of the media roller 35B is determined by a media position encoder 35C on the motor. An optical reader 35D senses the position of the encoder 35C and provides a plurality of output pulses which indirectly determines the position of the roller 35B and, therefore, the position of the media 33 in the Y axis.

The media and carriage position information is provided to a processor on a circuit board 36 disposed on the carriage assembly 30 for use in connection with printhead alignment techniques of the present invention.

The printer 10 has four inkjet print cartridges 38, 40, 42, and 44 that store ink of different colors, e.g., black, magenta, cyan and yellow ink, respectively. As the carriage assembly 30 translates relative to the medium 33 along the X and Y axes, selected nozzles in the inkjet print cartridges are activated and ink is applied to the medium 33. The colors from the three color cartridges are mixed to obtain any other particular color. Sample lines 46 are typically printed on the media 33 prior to doing an actual printout in order to allow the optical sensor 50 to pass over and scan across the lines as part of the initial calibration.

The carriage assembly 30 positions the inkjet print cartridges and holds the circuitry required for interface to the ink firing circuits in the print cartridges. The carriage assembly 30 includes a carriage 31 adapted for reciprocal motion on front and rear slider rods.

As mentioned above, full color printing and plotting requires that the colors from the individual print cartridges be precisely applied to the media. This requires precise alignment of the print cartridges in the carriage. Unfortunately, paper slippage, paper skew, and mechanical misalignment of the print cartridge results in offsets in the X direction (in the media advance axis) and the Y direction (in the carriage or axis) as well as angular theta offsets. This misalignment causes misregistration of the print images/graphics formed by the individual ink drops in the media. This is generally unacceptable as multi-color printing can typically require image registration accuracy from each of the printheads to within $\frac{1}{2400}$ inch.

Figure 4:
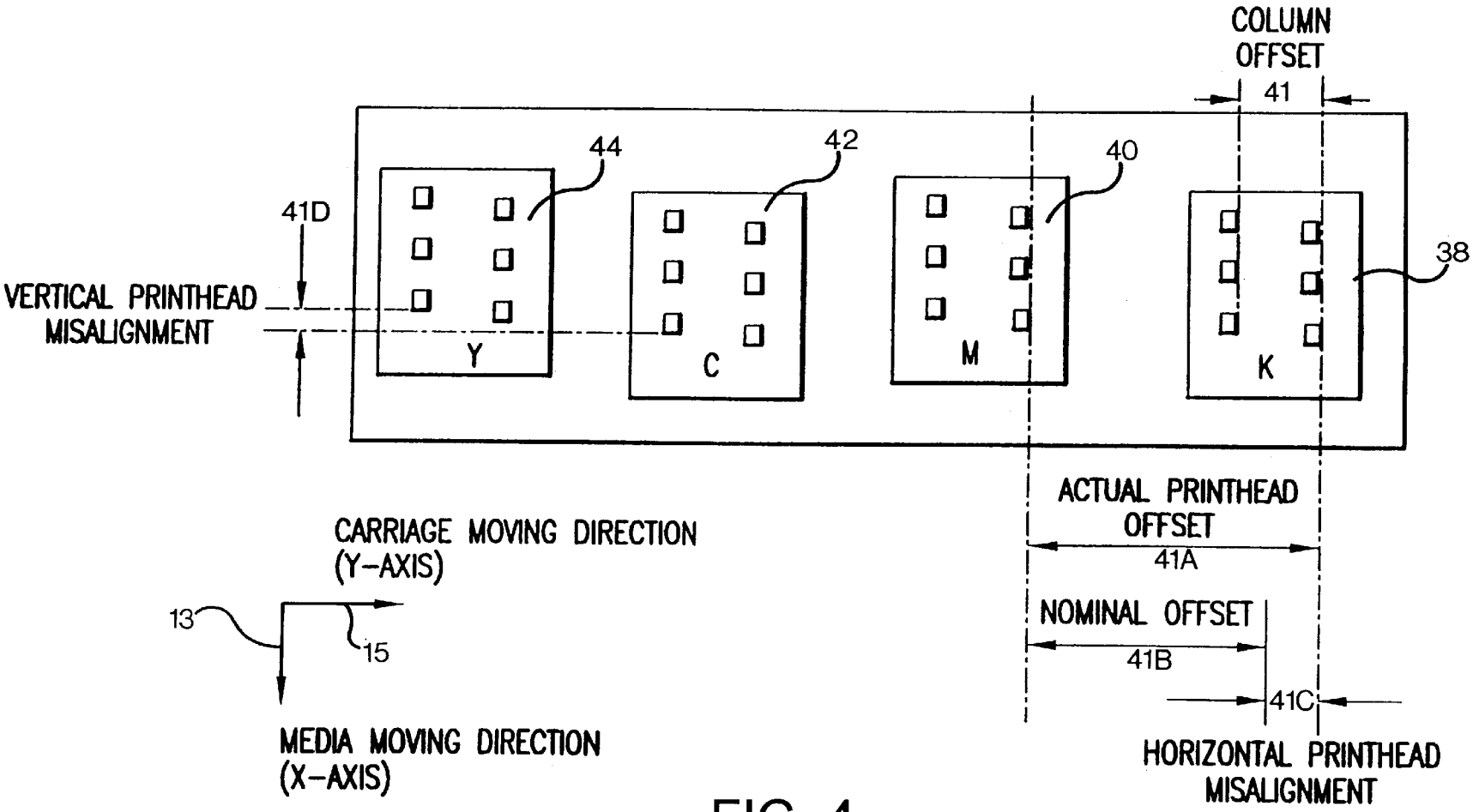
FIG. 4 is a schematic representation of a top view of a carriage showing offsets between individual printheads in the media advance axis and in the carriage scan axis.

FIG. 4 shows a presently preferred embodiment of printheads 38, 40, 42, 44 each having two groups of nozzles with a column offset 41. By comparing the relative positions of corresponding nozzles in different printheads along the Y axis, it is possible to determine an actual horizontal offset 41A between two printheads, and by comparison with a nominal default offset 41B determine an actual offset 41C in the carriage scan axis. This is repeated for all of the different printheads while they remain on the carriage.

Similarly, by comparing the relative positions of corresponding nozzles in different printheads along the X axis, it is possible to determine an actual vertical offset 41D in the media advance axis. This is also repeated for all of the different printheads while they remain on the carriage.

Figure 5:
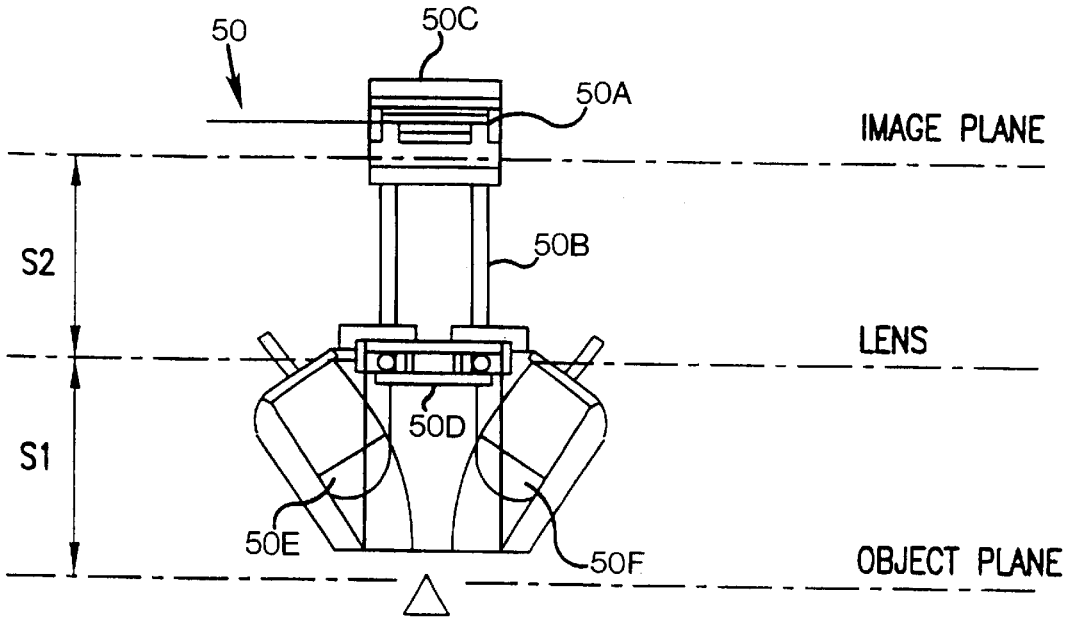
FIG. 5 is a front view of the optical components of the sensor unit of FIG. 4.
Figure 7:
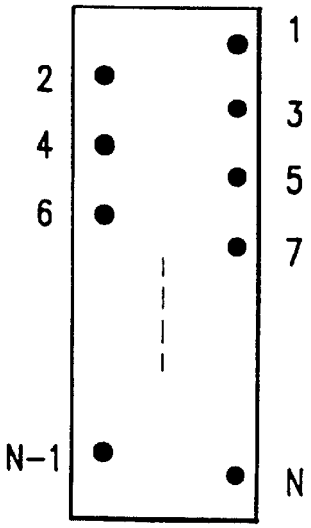
FIG. 7 schematically shows the nozzle plate of a 600 dpi print carriage having one column of ink-ejection nozzles separated from another column of ink-ejection nozzles.
Figure 8:
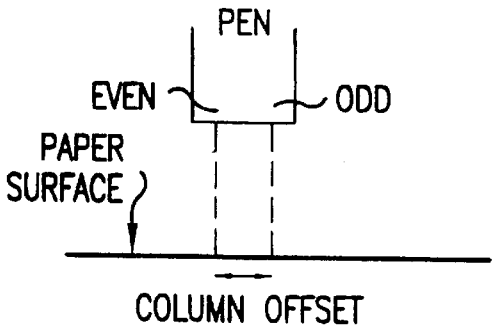
FIG. 8 schematically shows the print cartridge of FIG. 7 in printing position over a print zone.
Figure 6B:
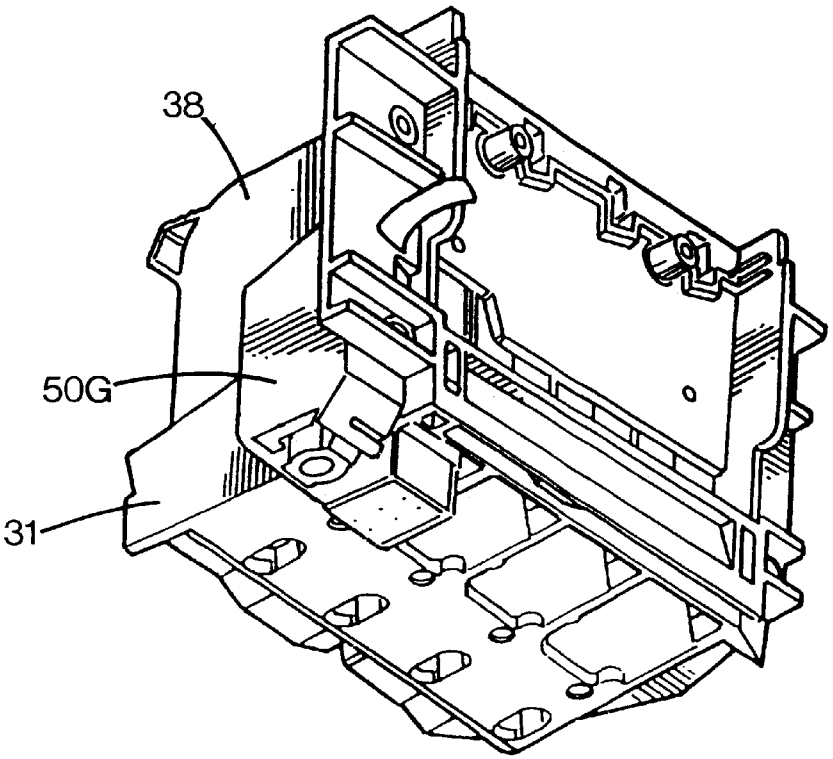
FIGS. 6A and 6B are isometric views respectively looking downwardly and upwardly toward the carriage showing the optical sensor and one print cartridge mounted on the carriage.
Figure 6A:
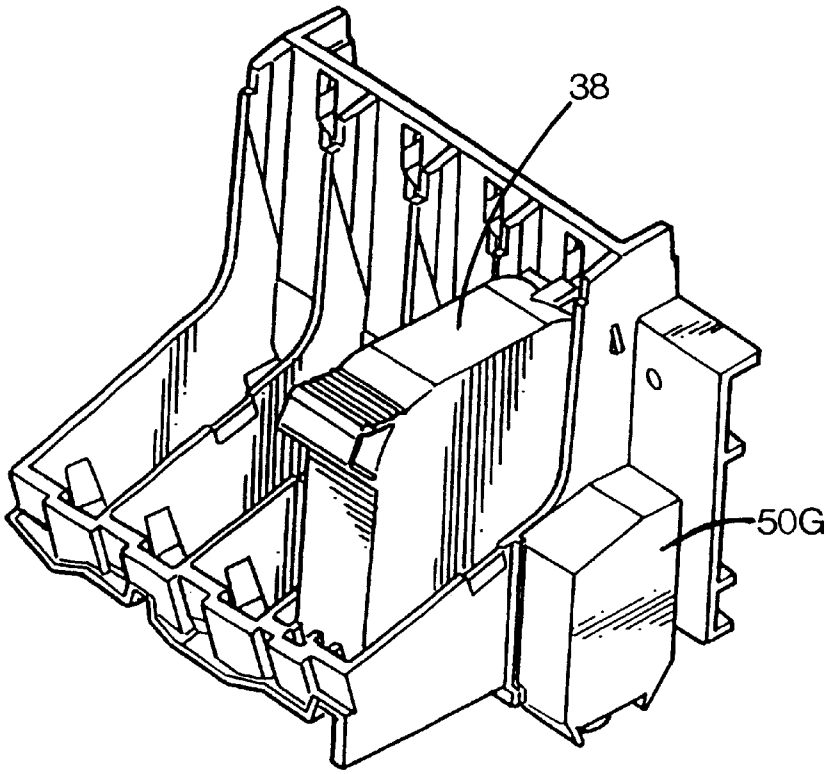

In order to accurately scan across a test pattern line, the optical sensor 50 is designed for precise positioning of all of its optical components. Referring to FIGS. 5, 6A and 6B, the sensor unit includes a photocell 50A, holder 50B, cover 50C, lens 50D; and light source such as two LEDs 50E, 50F. A protective casing 50G which also acts as an ESD shield for sensor components is provided for attachment to the carriage.

Additional details of the function of a preferred optical sensor system and related printing system are disclosed in corresponding application Ser. No. 08/551,022 filed Oct. 31, 1995 entitled OPTICAL PATH OPTIMIZATION FOR LIGHT TRANSMISSION AND REFLECTION IN A CARRIAGE-MOUNTED INKJET PRINTER SENSOR, which application is assigned to the assignee of the present application, and is hereby incorporated by reference.

The optical sensor in this exemplary embodiment includes two LEDs, one green and one blue. The green LED is used to scan all of the patterns except the patterns used to obtain information from the yellow ink printhead.

The signal read from the optical sensor is processed and entered to an analog-to-digital converter.

The printhead alignment techniques in accordance with this invention are now described in detail.

Before starting the calibration process a certain length of paper is pulled from the roll and after is pushed back behind, hanging below the roller. This deactivates the media roll "back-tension" which acts as a brake for the paper advance and produces some errors described above. This method is applied before measuring dot placement on paper-axis and also before measuring dot placement in scan-axis for the reference printhead.

Figure 9:
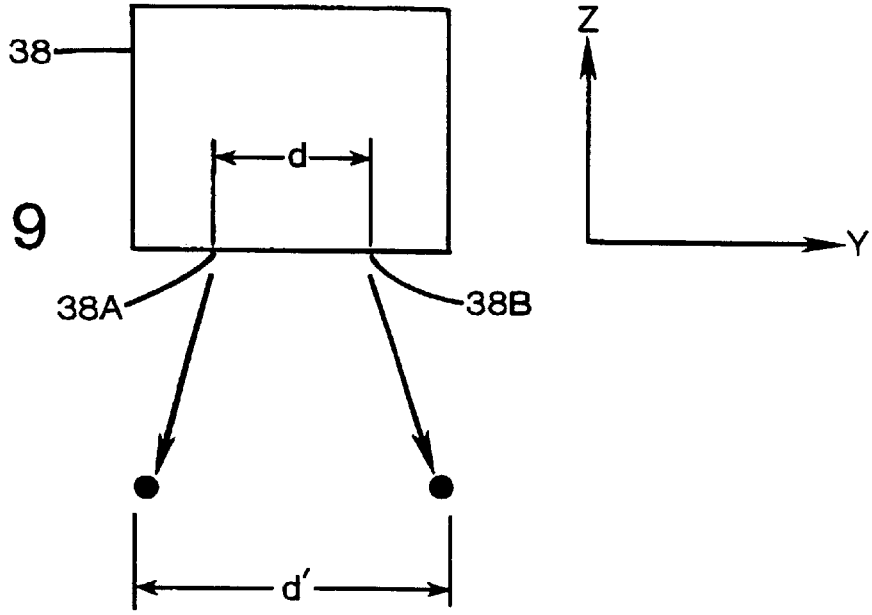
FIG. 9 diagrammatically illustrates SAD error.

Pen primitives (or also called physical primitives) are groups of nozzles in the same pen column that can be fired in advance or delay with respect to the firing pulse, due to a 'quarter dot correction' or other correction with the purpose of correcting for scan axis directionality (SAD) or adjacent primitive centroid separation (APCS) problems. Pen primitives are described in detail in pending application Ser No. 09/199,882, referenced above, and illustrated in FIG. 3 thereof. SAD errors, also sometimes known as column separation errors, consist in perpendicularity errors of the drop ejection direction with the respect to the nozzle plate in the plane YZ. SAD errors often manifest themselves symmetrically in the two nozzle columns of the printheads. SAD errors are measured as a column to column offset; two nozzles that are a distance d apart from each other in the printhead eject two droplets that fall on the print medium with an offset d'. This is illustrated in FIG. 9, wherein printhead 38 with corresponding nozzles of nozzle columns 38A, 38B spaced apart by distance d eject droplets that fall on the print medium a distance d' apart.

Figure 10:
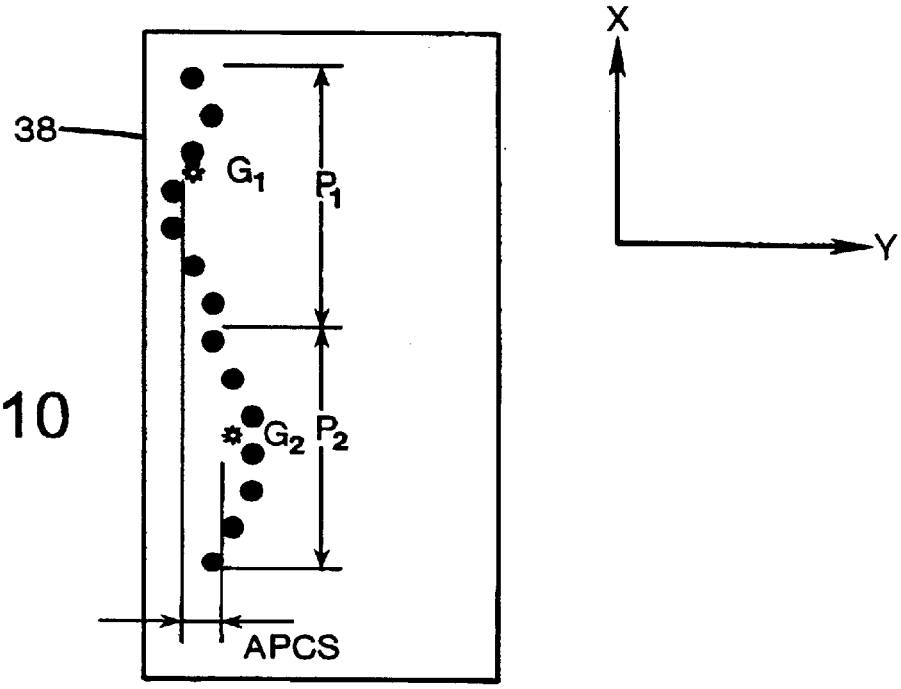
FIG. 10 diagrammatically illustrates APCS errors in a printhead.

APCS errors, also sometimes known as column straightness errors, consist in perpendicularity errors of the drop ejection direction with respect to the nozzle plate in the plane XY. These errors refer to the straightness of one single printhead nozzle column. APCS errors are measured as offsets in the Y axis between groups of droplets from two adjacent primitives. This is illustrated in FIG. 10, wherein $P_1$ and $P_2$ are groups of droplets ejected by respective primitives of printhead 38. $G_1$ and $G_2$ represent the respective centroids of the groups of droplets. The offset between the two centroids is the APCS error.

In an exemplary embodiment, the pen primitives are groups of 16 nozzles, and the printer electronics and firmware use logical primitives which include 32 nozzles (less at the ends of the printhead depending on the paper axis correction). The logical primitives can be fired in advance or with delay to their nominal firing time. This is described more fully in application Ser. No. 09/199,882, entitled ALIGNMENT OF INK DOTS IN AN INKJET PRINTER, referenced above.

In this example, for simplicity, the word 'primitive' refers to primitives of 32 nozzles each, so each printhead column will have 8 primitives (32 nozzles each). The printhead has two columns, the odd column and the even column. The odd column contains even primitive numbers; the even column contains correspondingly odd primitive numbers. When reference is made to nozzles or primitives, i.e., "first primitive of the odd column", this means the first 32 usable odd nozzles after the pen to pen in media axis alignment. A dot row is used as an equivalent for a pixel, in this example 1/600 of an inch or 42 microns. When, e.g., a column printed with the odd column is 448 dot rows tall, that means that there are 224 droplets (each column of the pen is at 300 dpi).

Figure 11:
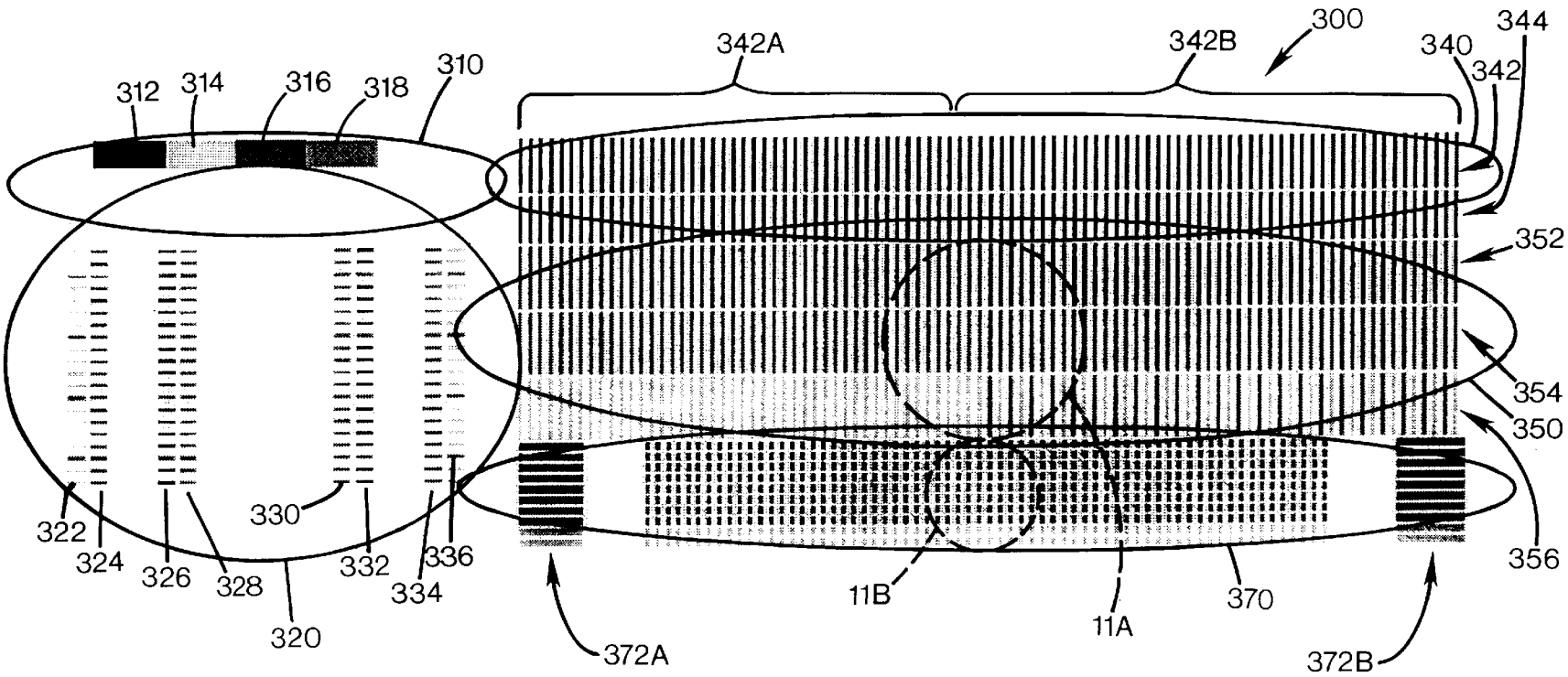
FIGS. 11, 11A, and 11B show a printhead alignment pattern printed in accordance with aspects of the invention.
Figure 11A:
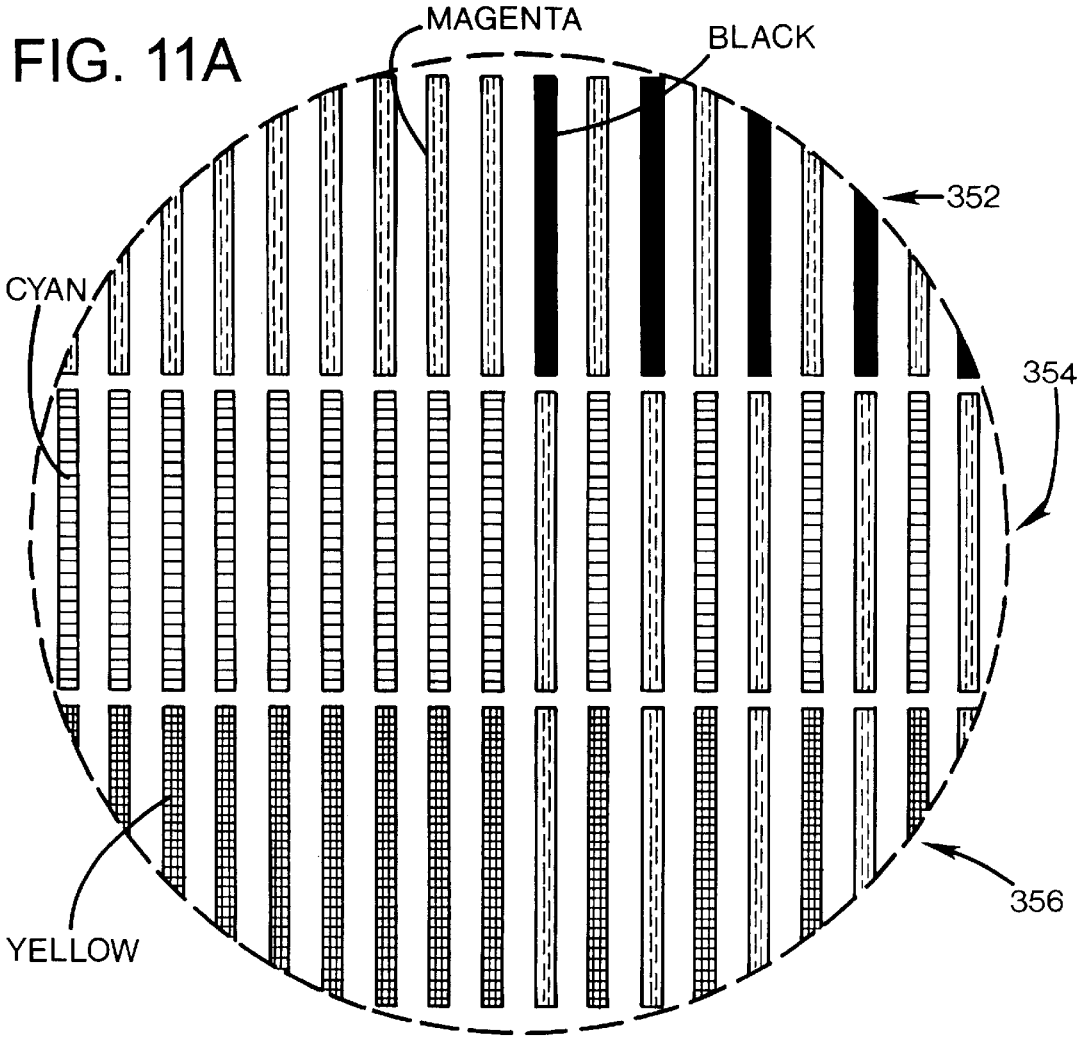
Figure 11B:
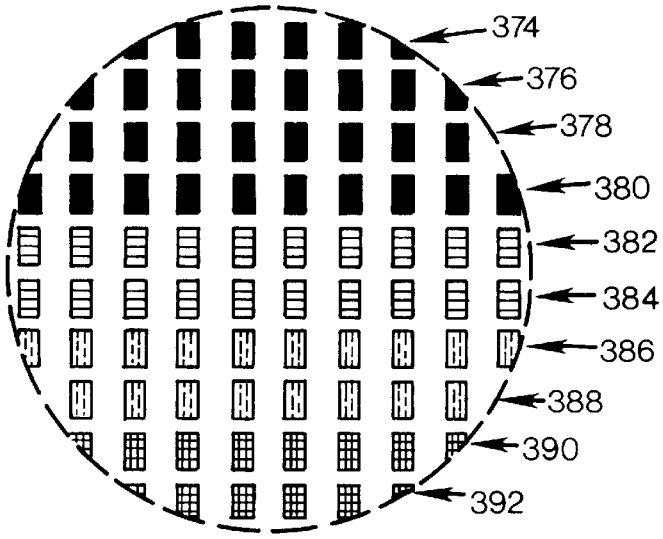

To accomplish a printhead alignment procedure in accordance with the invention, a set 300 of printhead patterns, sometime referred to herein as a "blanket," are printed. This alignment procedure is typically performed at printhead replacement, either immediately after the replacement, or after a power up and a new printhead is detected. Alternatively, the printhead alignment procedure can be manually triggered by the user through a printer front panel input. FIG. 11 illustrates an exemplary blanket 300. The printhead alignment patterns include a number of color blocks printed on the print medium, e.g. paper, to be scanned using the printer's line sensor. Subsequent to scanning, distances between blocks are measured, and corrections are calculated comparing the measured distances with the targeted distances between blocks.

The upper side of the blanket 300 is adjacent the leading edge of the print medium in FIG. 11, and so the printer carriage would be located at the bottom of the illustration. Therefore, a forward movement of the paper refers to a displacement in the up direction in the context of FIG. 11, and a backward movement of the paper refers to a displacement in the down direction.

In an exemplary implementation on a large format printer, the size of the blanket 300 is 15 cm by 55 cm, and about 6 minutes are used to print and scan the blanket, including the dry times. The invention can be implemented by first printing the blanket in its entirety before any scanning. However, in the following description, the invention is described as implemented with partial blanket printing, then partial scanning, then partial printing, scanning, etc. Either technique may be employed in practicing the invention.

The sizes and spacing of the blocks respond to the line sensor field of view, which is approximately 47 dot rows (1.6 mm) in this embodiment. A desired width of the blocks for the scan axis measurements (36 dots) corresponds to an optimum for the centroid search algorithm. This algorithm analyzes the line sensor signal and determines the centroids of the blocks by adjusting a cosenoidal waveform to each peak in the waveform. Centroid search algorithms are well known in the art, and include fitting the cosenoidal curve to the scanned signal data, using a "minimum squares fit" method.

The blocks for the media axis (X-axis) measurements are also 36 dots high (they are scanned in the media axis direction) but their spacing is bigger (512/5-36), since it has to be an entire number of blocks every swath, and with an approximately equal spacing between swaths. The block spacing for this exemplary embodiment is determined in the following manner. A block is at least 36 dot rows thick for signal reasons. The minimum spacing is 55 dot rows for field of view reasons. Therefore the spacing between blocks for the X-axis measurements is (36+55+margin)*n =512, where 512 is the swath height (printhead height) and n must be an integer number. So the margin is 11, except in the space between swaths where it is 13.

Several paper movements or wait times correspond to dry times, before moving the media backwards, again under the pinch wheels of the media drive system. This will allow the ink to dry before a portion of a printed pattern is reversed in movement, taking it under the output pinch wheels, to minimize smearing the pattern.

The pen servicing procedures are important for the repeatability of the pen alignment procedure. These parameters include, in an exemplary embodiment, warming the printhead at an appropriate temperature by means of supplying short electrical pulses to the nozzles, to ensure optimum drop weight. Other exemplary pen servicing parameters include firing a certain number of drops per nozzle before printing the alignment patterns to ensure optimum drop directionality and drop stability, and eliminating dry ink from the nozzle bores. These procedures will preferably be performed before a printhead alignment procedure is conducted in accordance with the invention.

Prior to the printhead alignment being conducted, in the exemplary large format printer, several calibrations will have been performed. These include service station calibration which determines the distance between the optical center of the line sensor with respect to the center of the black printhead. A media advance calibration corrects the eccentricity, worm, gear and other periodic errors in the paper advance. Color-to-color calibration determines the chassis straightness effect on dot placement errors and introduces an offset (if necessary) in the color-to-color calculations performed by the pen alignment, and is described in further detail in pending application Ser. No. 09/253,694, entitled COLOR TO COLOR CALIBRATION, the entire contents of which are incorporated herein by this reference. A theta-X calibration technique can be used to determine the amount of theta-X errors induced by pen to paper relative rotations and to modify theta-X corrections for the reverse directions, as described in further detail in European Patent Application 99103185.7.A mark encoder calibration determines the absolute zero in the media axis encoder. A pen-to-media spacing calibration also corrects for pen-to-media spacing variations along the scan axis (mainly noticeable in bi-directional printing at high carriage speeds), and is described in further detail in pending U.S. application Ser. No. 09/259,070, entitled PEN TO PAPER SPACING.

There are five main areas in the blanket 300, which will now be described in more detail.

First Area 310

Line Sensor Calibration. Four blocks or solid tiles 312, 314, 316, 318 are printed, one for each printhead, e.g. black tile 312, yellow tile 314, magenta tile 316 and cyan tile 318, having areas at least as big as the line sensor field of view. The line sensor scans these tiles, obtaining the maximum and minimum signal level. An algorithm chooses for each line sensor LED, the best gain channel, offset and LED intensity targeting to maximize the signal range.

Second Area 320

Pen-to-Pen In Media (X) Axis and Pad Factor. Eight vertical stripes 322–336 with 20 rectangles each are printed in consecutive swaths using a mask of 50% density, i.e. wherein each nozzle only prints one pixel in every two pixel. This means that the rectangles are printed using both odd and even nozzles of each printhead and, in this example, at a firing frequency of 6 Khz. This firing frequency is for a carriage speed of 20 inches per second, the pen firing one of every two pixels on the media (equivalent to fill half the cells on a 600 dpi grid.) The media advance error has first been calibrated, by the aforementioned calibrations conducted before commencing the printhead alignment procedure. The reference printhead for this calibration, i.e. the pen-to-pen calibration in the X axis direction, is the magenta pen. For each pen there are two stripes (to gain repetitions); each of the stripes has a length of four swaths.

For each swath used to print the stripes comprising area 320, the magenta printhead is used to print the center block, and the other blocks for a swath in a given stripe printed by a printhead of a different color. Thus, stripes 322 and 326 mostly printed with yellow but with four blocks of magenta interleaved along the length of the stripes, the magenta blocks being the central block printed in a the respective four swaths. Similarly, stripes 324 and 334 are mostly printed with cyan but with four blocks of magenta printed as the central block in each swath. Stripes 328 and 332 are mostly printed with black but with four blocks of magenta printed as the central block for each swath used to print the respective stripe. Stripes 328 and 330 are printed with all magenta blocks. This use of the magenta printhead to print the central block allows for measurement of pen-to-pen alignment along the media axis, with the magenta printhead being used as the reference, allowing calculation of the offset between printheads along the media axis.

Two measurements are done in the same pattern. The first measurement, pen-to-pen in the media axis (X-axis) direction, is made swath by swath, i.e., every five blocks. The central block is always printed by the magenta printhead (the reference printhead). The four blocks (two upper and two lower) adjacent the central block of each swath are used to calculate the center of the referenced pen. Misalignments between the center of the magenta block and the center of the referenced printhead are corrected with a resolution of 1 dot row. This is achieved by using only 512 of the 524 nozzles in one exemplary pen. The magenta pen always uses its 512 central nozzles, whereas in the other printheads, the 512 nozzles selected for use (out of 524 nozzles) can shift plus/minus six dot rows. In other words, to compensate vertical (X axis) mispositionings and/or misplacements of the printheads, a choice is made of which 512 nozzles are going to be used, and since there are 524 nozzles in the vertical direction, there is a choice of rows shifted plus/minus six dot rows. This procedure results in printhead to printhead alignment, so that the printheads are aligned with respect to the X axis.

A second measurement is the pad factor determination. The two blocks in each swath which are furthest apart are included in the calibration. The measured swath height is the distance between the upper block to the lower block in each swath, extrapolated over the whole printhead height, i.e. in this example this measured distance between the upper block and the lower block in each swath multiplied by 512. The pad factor is the ratio between the theoretical swath height (512 dot rows) and the measured swath height. The pad factor is applied to over-advance or under-advance the print media to achieve an optimum area filling without overlapping or gaps between the passes.

Third Area 340

Calibration of the Black Pen In The Scan (Y) Axis. This area is used to calibrate the black pen or printhead. The black printhead is more completely calibrated that the other printheads, so that it will have the most accurate dot placement of any of the printheads. This is done because the black printhead receives heaviest use during most applications including CAD applications, and dot placement errors are most noticeable for the black droplets. The third area 340 includes two horizontal bands 342, 344, printed by the black pen. Each band has two regions (one on the left and the other on the right), with 46 rectangles or blocks each. Thus, band 342 includes left region 342A and right region 342B. The left and right regions can not be distinguished by eye (unless there are nozzles out). The APCS error is measured using the left regions of the bands. The SAD error, i.e. the odd to even primitive centroid separation, is measured using the left regions of the bands.

Figure 13:
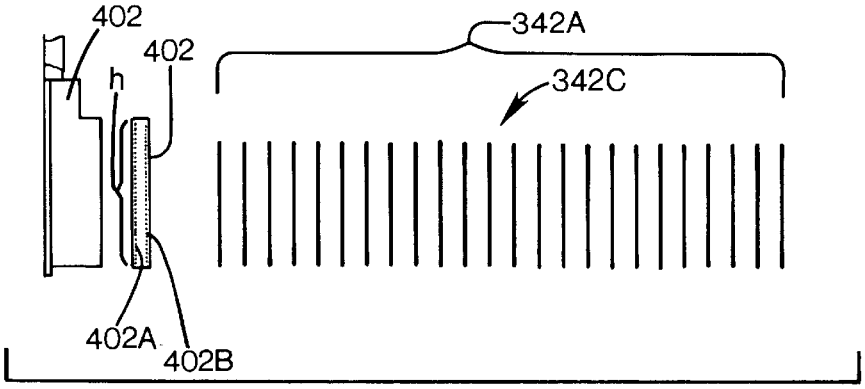
FIG. 13 is a diagrammatic depiction of a printhead and a portion of a first band of the black printhead alignment pattern.
Figure 14:
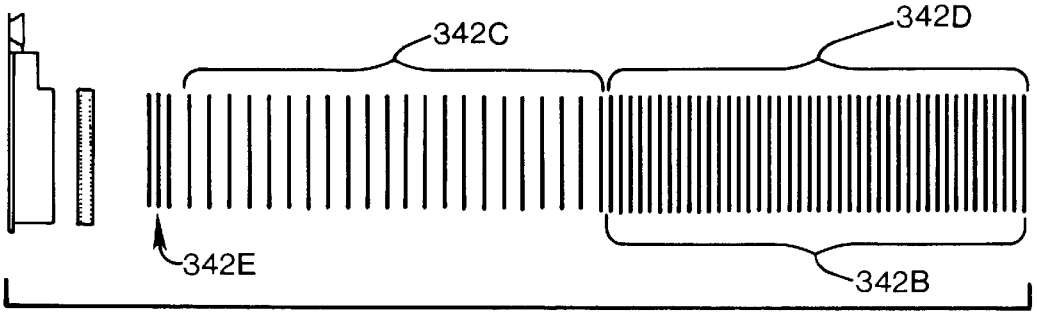
FIG. 14 illustrates the first band of FIG. 13 after completion.

All the measurements could be done only in the first band, adding one 64 dot row band for the first primitive swath, but it was chosen to do it in two bands with the purpose of swapping positions on the print medium between adjacent primitives. This is illustrated in FIGS. 13 and 14. The advantages of swapping position on the print medium between adjacent primitives include minimizing the contribution of sudden carriage velocity variations due to ink tube drag and other causes as well as carriage encoder errors or media errors.

FIG. 13 shows in schematic form a black pen printhead nozzle plate 400, with two columns of nozzles, the odd column 402A and the even column 402B. To print the first band 342, a set 342C of 23 blocks is initially printed in a first pass using the last 7 primitives (224 bottom nozzles from 256) of the black pen, all from the odd column 402A, as shown in FIG. 13 (see height h of the printhead in FIG. 13). The set 342C is printed within the left side 342A of the first band. The spacing between the blocks of this set 342C is 146 dots in this example. These spaces will be filled with another set of 23 blocks printed in the second pass, after some print medium (X-axis) advance. The right region 342B will be filled with blocks forming the same kind of pattern in the second pass, i.e. with a total of 46 spaced blocks.

The 23+46 blocks of the second pass are printed after moving the print medium forward along the X-axis for a distance of 64 dot rows, i.e. by a distance equal to the height of one primitive. These blocks include the 46 blocks 342D printed in the right region 342B, and 23 block printed in the left region in the gaps between the blocks 342C printed in the first pass. For clarity, only one (342E) of the blocks printed in the second pass in the left region 342A is shown in FIG. 14.

The first 23 blocks of the second pass are printed in the left region 342A using the 224 top nozzles (starting in primitive 1) of the black pen 402, also from the odd column 402A. The other 46 blocks (in the right region) are printed alternatively with odd and with even nozzles.

The purpose of this procedure, for the left region, is to locate adjacent odd primitives side by side in alternate blocks on the print medium in the left region 342A. This is achieved with a single media advance of 64 dot rows which introduces very small advance-skew errors. The left region pattern therefore contains 7 (out of 8) primitives from the odd column positioned side by side laterally every couple, i.e.,the first and second primitives of the odd column are printed side by side in the scan axis, at the same X position due to a media advance. In this example, then, adjacent pairs of the blocks will position blocks printed by the second odd black primitive adjacent the first primitive, and so on, i.e. third primitive adjacent the second primitive, fourth primitive adjacent the third primitive, fifth primitive adjacent the fourth primitive, seventh primitive adjacent the sixth primitive, and eight primitive adjacent the seventh primitive.

In the right region 342B, blocks printed with the odd and with the even columns alternatively allow the measurement of the distance between odd nozzles to their corresponding even nozzles in the other column of the printhead, i.e. to measure the SAD error.

Figure 16:
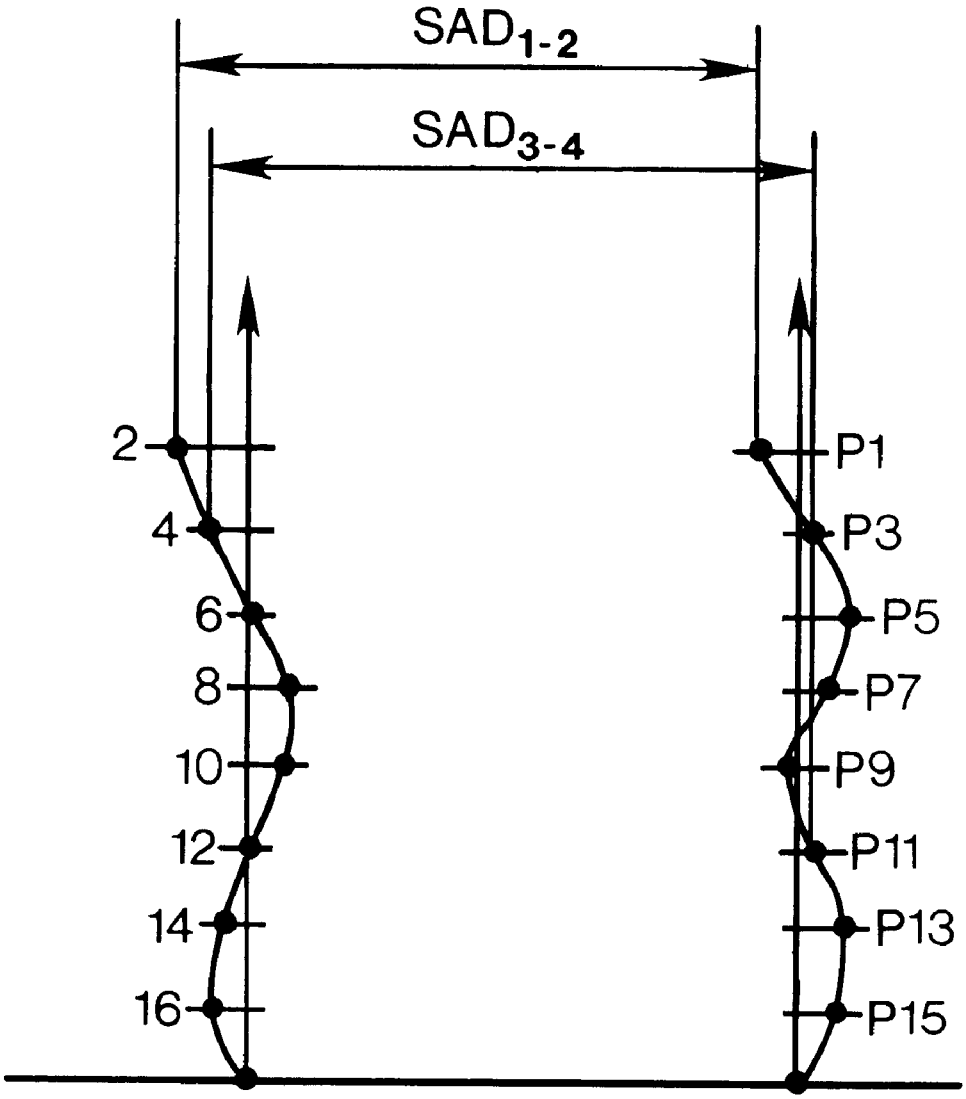
FIG. 16 illustrates the even and odd columns of the black printhead, and the illustrative distances SAD 1–2 and SAD 3–4.

The pattern 342 is then scanned with the line sensor. Three metrics are obtained, the magnitude of APCS for the odd column of the black printhead, the magnitude of SAD (odd to even distance), and the magnitude of APCS error for the even column of the black printhead. When measuring the odd to even distance, two magnitudes can be considered, the APCS profile of each of the pen columns, and the mean distance between them. FIG. 16 illustrates the even and odd columns of the black printhead, and the illustrative distances SAD 1–2 and SAD 3–4.

This exemplary technique does not differentiate between SAD and APCS of the even column of the black printhead, but it is not necessary to determine each separately but only their addition, i.e. the sum of SAD and APCS of the even column, since the correction of their addition ensures that odd and even droplets will reach their target position on the print medium.

Figure 15:
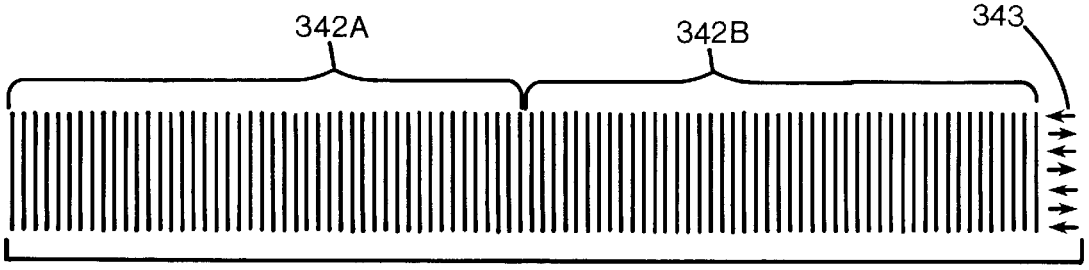
FIG. 15 illustrates the scanning of the first band of FIG. 14 in successive bidirectional passes of the line sensor.

Scanning with the line sensor is done bi-directionally to reduce scan time. Each block is 448 dot rows tall in this example (7 primitives). Thus, seven passes are needed to completely scan the pattern. This is illustrated in FIG. 15, with arrows 343 indicating the seven scanning passes.

The scanning begins at the top of the band 342A, immediately after printing the second pass. The print medium is first moved backwards (in the X axis) to position the line sensor on the first 64 dot rows of the blocks.

Although the line sensor covers the whole length of the band when scanning all 7 passes, the data corresponding to the left region is alternatively discarded. FIG. 15 illustrates the scanning data used in the first pass, and the scanning data used in the second pass; the third pass data is analogous to the first and so successively. Thus, the data saved from scanning the left region is a measurement of distance between blocks printed by the second and first primitives, the fourth and third primitives, the sixth and fifth primitives and the eight and seventh primitives, all of the odd nozzle column of the black pen. The reason for saving only this half of the data is that the other half of the data will be measured in the second band 344, as is discussed below.

For the right region 342B, all the data is used. Therefore, after scanning the first band, the distance between odd and even columns 402A and 402B of the black printhead is almost characterized except for one primitive (the eighth primitive). The APCS of the odd column is known only for five primitives (second to first, fourth to third, sixth to fifth and eighth to seventh). The remaining measurements will be obtained when the second band is printed as explained more fully below.

The second band 344 is printed and scanned using a procedure akin to that used for the first band 342. In the first print pass, half (23) of the blocks in the left region are printed using the odd column 402A of the black printhead 400. In this pass the second to the seventh primitives of the printhead are used (384 dot row tall blocks).

Then, before printing the second pass, the print medium is moved backwards in the X axis. The third to eighth primitives are then used to print 23 blocks in the gaps between the 23 blocks printed in the left region during the first pass. For the left region, adjacent portions of pairs of the blocks are printed with second and third primitives, the third and fourth primitives, the fourth and fifth primitives, the fifth and sixth primitives, the sixth and seventh primitives, and the seventh and eighth primitives. Similar to the procedure for printing the first band, the right region is printed during the second pass with blocks printed alternatively with the odd and with the even columns 402A and 402B of the black printhead 400.

Scanning of the second band 344 with the line sensor is also done bidirectionally to reduce scan time. Each block is 384 dot rows tall (6 primitives). But only four passes are needed to scan the pattern to obtain the desired measurements. The scanning begins at the top of the band, after printing the second pass. Before scanning, the print medium is first moved backwards to position the line sensor on the first 64 dot rows of the blocks. Only the data in the left region is used now except the last scan.

The four scans are done on the whole length of the second band 344. Starting with the first 64 dot rows of the band and continuing, the distances between adjacent block portions printed by the second and third primitives, by the fourth and fifth primitives, and by the sixth and seventh primitives are measured. The data for the right region is not used except the last row which includes the odd-even pattern which was not printed in the first band 342 (corresponding to the eighth primitive of the odd and the even columns).

The data from the left region of the second band is used, with the data from the left region of the first band, to characterize the distances between each adjacent pair of left column primitives of the black pen. The media (X) axis position of the pairs to be measured is the opposite to the position they had in the first band. For example, if in the first band primitive 2 is in the same scan axis position as primitive 3, with primitive 2 to the left of primitive 3, then in the second band primitive 3 is in the same media (X) axis position as primitive 2, with primitive 3 now to the left of primitive 2. Thus, the positions of primitive 2 and primitive 3 are swapped in the second band, relative to their positions in the first band. By swapping the positions from the first band to the second band, if encoder errors or scan axis errors had created errors in the measurement of the first band, now due to the swapping of positions of the primitives, these errors have the opposite sign, avoiding error accumulation.

Fourth Area 350

Color-to-Color In Scan (Y) Axis and Color SAD/APCS. The fourth area 350 has three bands 352, 354, 356 (FIG. 12), each band having a left region and a right region as discussed above regarding the bands 342, 344 for area 340. The first band 352 is used to measure the relative errors in the magenta pen with respect to the black one. The second and third bands 354 and 356 respectively use the magenta pen as reference for the cyan and yellow colors respectively. Each band is printed and scanned before proceeding to the following one in this exemplary embodiment.

The left region of each band 352, 354, 356 is used for the SAD/APCS measurement for the corresponding color. The blocks in the left region are alternatively printed with odd and even nozzles of the pen. The right region of each band 352, 354, 356 is used for the APCS/Color to Color measurement for each color. The blocks in the right region are alternatively printed with odd reference nozzles and odd referred nozzles of the pen being measured and the reference pen.

Eight scans (8×64 dot rows each) are performed bi-directionally, and similarly to the scans for the black printhead. For the magenta color, the APCS and Color-to-Color measurements are translated into only APCS by subtracting the APCS value of the black printhead odd column from the measured distances between Magenta odd and Black odd. The value of the magenta odd column to black odd column offset is stored to apply to the first primitive of the magenta pen, which acts as the reference for the yellow and cyan measurements. The procedure is similar for the cyan and yellow printheads, with the only difference that the magenta printhead is here used as a reference instead of the black printhead. The SAD value is again unnecessary, and only the addition of SAD plus APCS for the even column are stored for each printhead after measuring the left region of each band.

Figure 12:
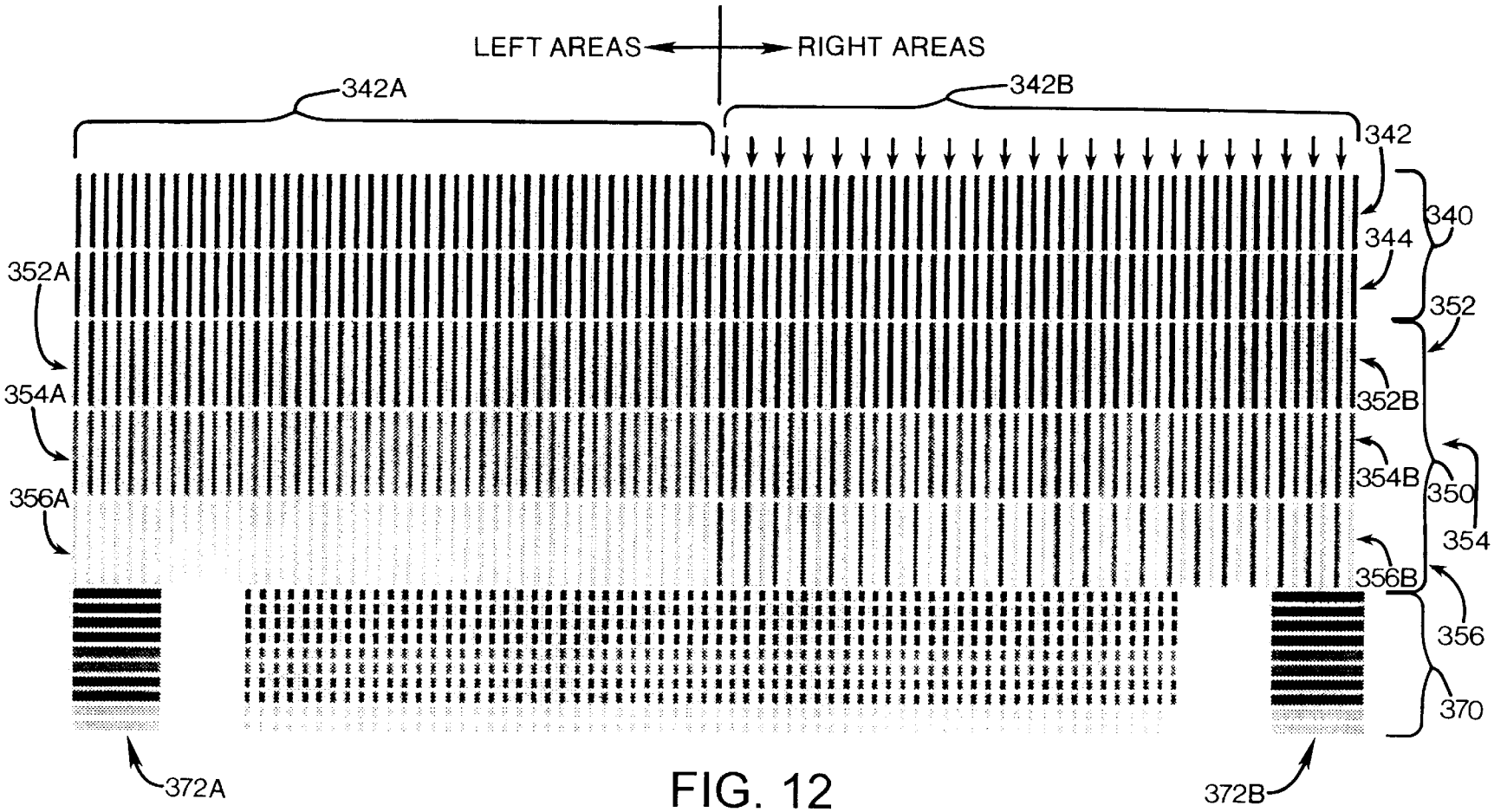
FIG. 12 is an enlarged view of a portion of the alignment pattern of FIG. 11.

The left region 352A of band 352 has 46 blocks, alternatively printed with the nozzles of the odd column and the even column of the magenta printhead. The right region 352B of band 352 has 46 blocks, alternatively printed with the nozzles of the odd column of the black printhead and the nozzles of the odd column of the magenta printhead. This is illustrated in FIG. 12, wherein the blocks printed by the reference printhead, i.e. the black printhead, are shown in solid form, and the blocks printed by the printhead to be measured, i.e. the magenta printhead, are show in shaded form.

During scanning, the distances between the blocks printed by the odd column and the even column of the magenta printhead are measured, using the left area 352A blocks. The distances between the blocks printed by the reference printhead and the printhead under measurement are measured using the right area 352B blocks.

The left region 354A of band 354 has 46 blocks, alternatively printed with the nozzles of the odd column and the even column of the cyan printhead. The right region 354B of band 354 has 46 blocks, alternatively printed with the nozzles of the odd column of the magenta printhead and the nozzles of the odd column of the cyan printhead. This is illustrated in FIG. 12, wherein the blocks in left area 354B printed by the reference printhead, i.e. the magenta printhead, are shown in solid form, and the blocks printed by the printhead to be measured, i.e. the cyan printhead, are show in shaded form.

During scanning, the distances between the blocks printed by the odd column and the even column of the cyan printhead are measured, using the left area 354A blocks. The distances between the blocks printed by the reference printhead and the printhead under measurement are measured using the right area 354B blocks.

The left region 356A of band 356 has 46 blocks, alternatively printed with the nozzles of the odd column and the even column of the yellow printhead. The right region 356B of band 356 has 46 blocks, alternatively printed with the nozzles of the odd column of the magenta printhead and the nozzles of the odd column of the yellow printhead. This is illustrated in FIG. 12, wherein the blocks in left area 356B printed by the reference printhead, i.e. the magenta printhead, are shown in solid form, and the blocks printed by the printhead to be measured, i.e. the yellow printhead, are show in shaded form.

During scanning, the distances between the blocks printed by the odd column and the even column of the yellow printhead are measured, using the left area 356A blocks. The distances between the blocks printed by the reference printhead and the printhead under measurement are measured using the right area 356B blocks.

The SAD, APCS and color to color corrections are calculated from the obtained measurements. At this point, if the printer had performed any previous calibrations, e.g., chassis straightness, some re-calculations will be applied on the corrections to achieve the optimum corrections. A "minimax" algorithm is used to minimize the maximum remaining error. Minimax algorithms are well known in the art, and are used to solve equation systems with discretization errors. This type of algorithm chooses the solution with the smallest maximum amount of error. Minimax algorithms are described, e.g., in "Numerical Recipes in C, The Art of Scientific Computing," by William H. Press et al., Cambridge University Press, at pages 204–205, 1996.

Fifth Area 370

Bi-Directional Alignment. In this area 370, ten bands are printed bi-directionally. Each band is only 64 dot rows tall; and 100% dense, this is because both odd and even nozzles are firing at the same time and no print mask is used.

For the black printhead, two bands 374, 376 are printed at a carriage velocity of 20 inches per second (ips) and two bands 378, 380 are printed at 40 ips. The first band is formed with blocks printed in the forward and reverse directions alternatively with the top primitives of the printhead (odd and even together). The second band uses the same method but the bottom primitives (odd and even together). The third and fourth are equivalent to the first and second but printed at 50% density (40 ips).

The color bands are printed only at 20 ips using top and bottom primitives of the printhead in a similar way. Thus, bands 382, 384 are printed with the cyan printhead in this example, bands 386,388 with the magenta printhead, and bands 390, 392 with the yellow printhead. The results from the bi-directional scanning affect the calculation for the pen to pen alignment values obtained in area 350. The pen-to-pen alignment values in the scan axis reverse direction are determined, by adding an offset to the pen-to-pen alignment values in the forward direction to provide the reverse direction alignment values. The offset is equal to the bi-directional error.

The number of blocks is 66 (greater than the 46 in the SAD measurements) to slightly increase the repeatability of the measurement.

These patterns 370 include warm-up areas indicated as areas 372A, 372B at the left and right edges, respectively because in bi-directional printing decap problems could appear as a consequence of dried ink on the orifices, typically occurring when the printhead has been sweeping a long time above the paper without firing drops.

Figure 17:
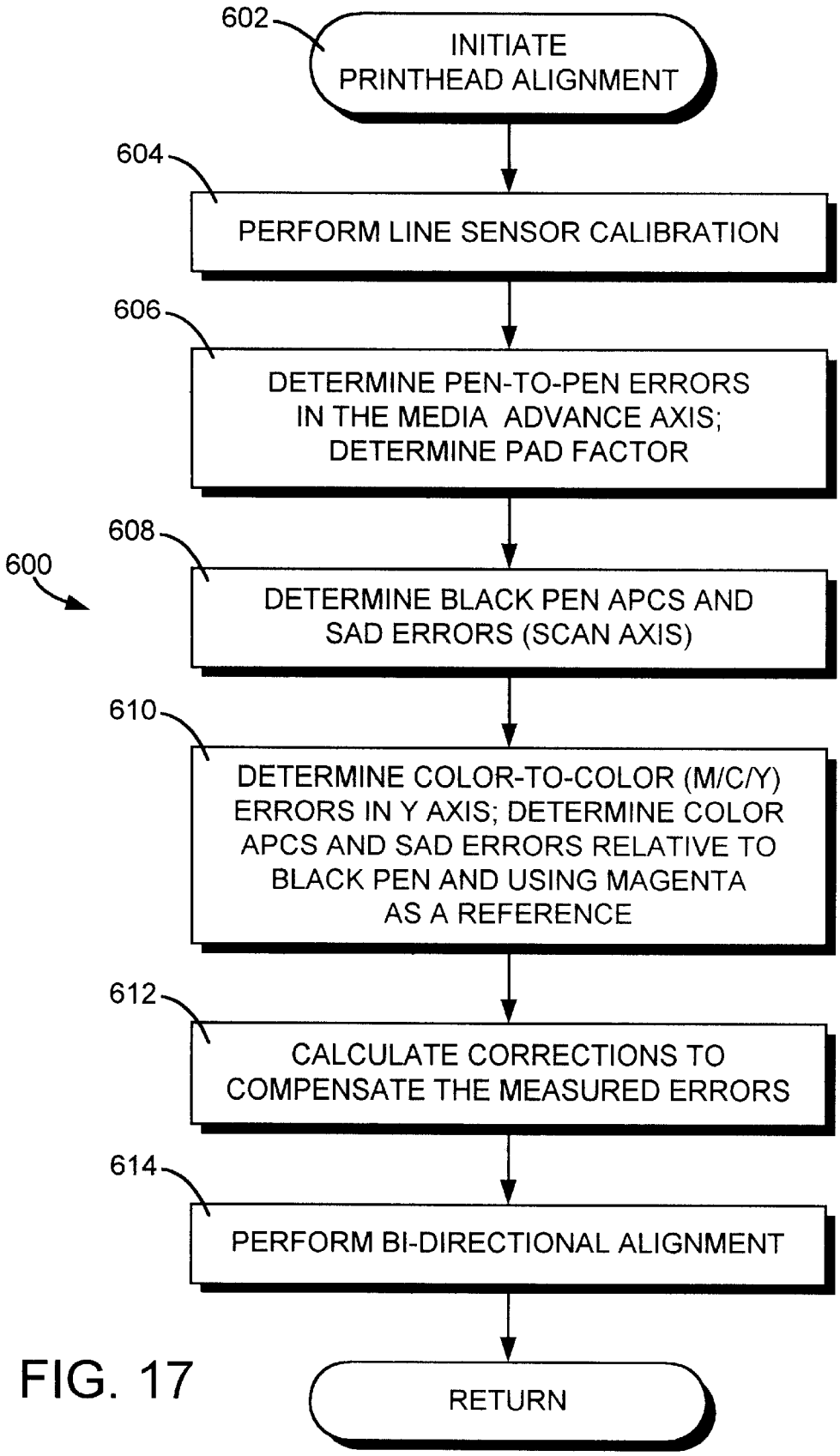
FIG. 17 is a simplified flow diagram illustrating the general steps of a printhead alignment technique as described with respect to FIGS. 11–16.

FIG. 17 is a simplified flow diagram illustrating the general steps of a printhead alignment technique 600 as described with respect to FIGS. 11–16. At step 602, the printhead alignment procedure is initiated, typically through a printhead change or by the user triggering the alignment through a menu selection. The line sensor is calibrated at 604, by printing the first pattern area 310, scanning the pattern with the sensor, and determining sensor calibration values to be applied.

At 606, pen-to-pen errors along the X-axis are measured, by printing and analyzing the second pattern area 320. As noted above, the black, cyan and yellow printheads can be aligned relative to the magenta printhead to correct the X-axis errors measured in this step.

At 608, the black pen is used to print the third pattern area 340, comprising horizontal bands of blocks. By scanning and analyzing the third pattern area, the black printhead SAD and APCS errors in the Y-axis direction are determined.

At 610, the four pens are used to print the fourth pattern area, and to determine the color-to-color errors in the Y-axis direction. The black pen is used as a fixed reference for measuring the magenta Y-axis errors, and then the magenta printhead is used as the reference for measuring the yellow and cyan printhead Y-axis errors.

The measured errors are then utilized at 612 to calculate corrections to compensate the measured errors. These corrections can take the form of determining which 512 nozzles of the black, cyan and yellow pens to use to compensate the X-axis errors relative to the magenta pen, and for determining delays or advances in the firing for the logical primitives with respect to their nominal firing times, as described more fully with respect to application Ser. No. 09/199,882, entitled ALIGNMENT OF INK DOTS IN AN INKJET PRINTER, referenced above.

The bi-directional alignment is performed at 614, and operation then returns to the main program flow for the printer.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of sensing directional aberrations among ink-jet printhead nozzles on the same printhead, comprising:

mounting the printhead on a scanning carriage;

selecting one group of nozzles on said printhead and printing from said one group of nozzles a first repeating pattern of blocks on a print medium as the carriage is scanned along a scan axis;

advancing the print medium relative to the carriage along a media axis by an incremental distance relative to a swath height;

printing from said one group of nozzles a second repeating pattern on the print medium as the carriage is scanned along the scan axis, the second pattern including second pattern blocks interleaved between the first pattern blocks;

optically sensing the relative positions of the first and second patterns to record measurements for determining at least one directional deviation characteristic of the printhead.

2. The method of claim 1 wherein the printhead nozzles include nozzles arranged in a first column and nozzles arranged in a second column, and wherein said one group of nozzles is selected from the nozzles in the first column.

3. The method of claim 2 wherein said printhead nozzles of said printhead are divided into a plurality of primitives of adjacent nozzles, and the nozzles in a primitive are controlled by a common enabling signal, and wherein the at least one directional deviation characteristic of the printhead includes an adjacent primitive centroid separation (APCS) characteristic.

4. The method of claim 3 wherein said first and second patterns comprise a first pattern band on the print medium, and the method further comprises:

advancing the print medium relative to the carriage along the media axis to position the print medium to print a second pattern band on the print medium;

selecting a second group of nozzles on said printhead and printing from said second group of nozzles a third repeating pattern of blocks on a print medium as the carriage is scanned along a scan axis, wherein the second group of nozzles overlaps said first group and is offset by one primitive;

advancing the print medium relative to the carriage along a media axis by an incremental distance relative to a swath height;

printing from said one group of nozzles a fourth repeating pattern on the print medium as the carriage is scanned along the scan axis, the second pattern including second pattern blocks interleaved between the first pattern blocks;

moving the print medium backward relative to the carriage along the medium axis;

optically sensing the relative positions of the third and fourth patterns to record measurements for determining at least one directional deviation characteristic of the printhead.

5. The method of claim 4 wherein:

said optically sensing the relative positions of the first and second patterns includes storing a first set of measurements of alternating pattern blocks formed by a first set of alternating adjacent ones of the primitives;

said optically sensing the relative positions of the third and fourth patterns includes storing a second set of measurements of alternating pattern blocks form by a second set of alternating adjacent ones of the primitives; and further comprising determining said APCS characteristic using said first and second sets of measurements.

6. The method of claim 2, wherein the first pattern is printed over a first area scanned by the carriage, and said second pattern further includes a second pattern portion printed in a second area scanned by the carriage, said second pattern portion includes alternating blocks printed by nozzles of said first column and nozzles of said second column, and wherein said at least one directional deviation characteristic includes a magnitude of scan axis directionality (SAD) between nozzles of said first column and nozzles of said second column.

7. The method of claim 2 wherein the incremental distance is equivalent to the height of a primitive, wherein said first and second patterns include pattern blocks in the same media axis position printed by corresponding nozzles of adjacent primitives.

8. The method of claim 1 further comprising, after printing said second repeating pattern and before said optical sensing:

moving the print medium backward relative to the carriage along the medium axis by a distance sufficient to position an optical sensor over the first pattern.

9. The method of claim 1 wherein said printhead is a black ink printhead.

10. A method of sensing directional aberrations among inkjet nozzles of a plurality of printheads mounted on a scanning carriage, comprising:

printing a first pattern of blocks on a print medium using only nozzles on a first printhead;

optically scanning said first pattern to determine measurements for determining directional aberrations between nozzles of the first printhead;

advancing the print medium along a media axis to position the medium for printing a second pattern of blocks;

printing a second pattern of blocks using only nozzles of said first printhead and a second printhead, the first printhead and second printhead for emitting droplets of ink of respective first and second colors;

optically scanning said second pattern to determine measurements for determining directional aberrations between nozzles of said second printhead and directional aberrations between nozzles of the second printhead and nozzles of the first printhead, using the first printhead as a reference.

11. The method of claim 10 further including:

advancing the print medium along the media axis to position the medium for printing a third pattern of blocks;

printing a third pattern of blocks using only nozzles of said second printhead and a third printhead, the third printhead emitting droplets of ink of a third color;

optically scanning said third pattern to determine measurements for determining directional aberrations between nozzles of said third printhead and directional aberrations between nozzles of the second printhead and nozzles of the third printhead, using the second printhead as a reference.

12. The method of claim 11 further including:

advancing the print medium along the media axis to position the medium for printing a fourth pattern of blocks;

printing a fourth pattern of blocks using only nozzles of said second printhead and a fourth printhead, the fourth printhead emitting droplets of ink of a fourth color;

optically scanning said fourth pattern to determine measurements for determining directional aberrations between nozzles of said fourth printhead and directional aberrations between nozzles of the second printhead and nozzles of the fourth printhead, using the second printhead as a reference.

13. The method of claim 12 wherein said printing said fourth pattern and said optically scanning said fourth pattern are performed without any intervening movements of the print medium along the media axis.

14. The method of claim 11 wherein said printing said third pattern and said optically scanning said third pattern are performed without any intervening movements of the print medium along the media axis.

15. The method of claim 10 wherein said printing said second pattern and said optically scanning said second pattern are performed without any intervening movements of the print medium along the media axis.

16. The method of claim 10 further comprising an initial step of calibrating an optical sensor used for the optically scanning of said first pattern and said second pattern.

17. The method of claim 10 further comprising an initial step of sensing directional aberrations between nozzles of said printheads in the media direction.

18. The method of claim 10 wherein the ink color associated with the first printhead is black.

19. The method of claim 18 wherein the ink color associated with the second printhead is magenta.

20. A method for detecting the magnitude of directionality errors in a color inkjet printer having a plurality of printheads mounted in a scanning carriage for movement along a scan axis, the printheads for printing inks of different colors, each printhead including a column of nozzles arranged generally transverse to the scan axis, the printer including a media drive system for moving the print medium along a media axis generally transverse to the scan axis, the method comprising:

energizing nozzles of a first printhead while moving said carriage along the scan axis to print a first pattern on the print medium;

scanning the first pattern using an optical sensor to determine directionality errors of said first printhead array;

advancing the print media;

energizing nozzles of said first printhead and a second printhead while moving said carriage along the scan axis to print a second pattern on the print medium;

scanning the second pattern using the optical sensor to determine directionality errors of the second printhead relative to the first printhead;

advancing the print media;

energizing nozzles of said second printhead and a third printhead while moving said carriage along the scan axis to print a third pattern on the print medium;

scanning the third pattern using the optical sensor to determine directionality errors of the third printhead relative to the second printhead;

advancing the print media;

energizing nozzles of said second printhead and a fourth printhead while moving said carriage along the scan axis to print a fourth pattern on the print medium; and scanning the fourth pattern using the optical sensor to determine scan axis directionality errors of the fourth printhead relative to the second printhead.

21. The method of claim 20 wherein the ink color associated with the first printhead is black.

22. The method of claim 21 wherein the ink color associated with the second printhead is magenta.

* * * * *